United States Patent [19]

Takano et al.

[11] 3,986,940

[45] Oct. 19, 1976

[54] PROCESS FOR MANUFACTURING ELECTROLYTICALLY CHROMATED STEEL SHEET

[75] Inventors: Hiroshi Takano; Yoshitaka Kashiyama, both of Fukuyama, Japan

[73] Assignee: Nippon Kokan Kabushiki Kaisha, Tokyo, Japan

[22] Filed: Dec. 31, 1975

[21] Appl. No.: 645,887

[30] Foreign Application Priority Data

Feb. 4, 1975 Japan ..... 50-13963

[52] U.S. Cl. ..... 204/28; 204/56 R

[51] Int. Cl.[2] ..... C25D 11/38

[58] Field of Search ..... 204/56 R, 28

[56] References Cited

UNITED STATES PATENTS

| | | | |
|---|---|---|---|
| 3,679,554 | 7/1972 | Yamagishi et al. | 204/56 R |
| 3,772,165 | 11/1973 | Yamagishi et al. | 204/56 R |

*Primary Examiner*—R. L. Andrews

*Attorney, Agent, or Firm*—Flynn & Frishauf

[57] ABSTRACT

In a conventional electrolytic chromating bath, a steel sheet is subjected to a cathodic electrolytic chromate treatment at a relatively high speed of 400 to 1,000m per minute, to form simultaneously a lower layer of metallic chromium and an upper layer of hydrated chromium oxides on the surface of said steel sheet; and then, said electrolytically chromated steel sheet is subjected to an anodic electrolytic treatment under the following conditions in said electrolytic chromating bath, to adjust the amount of said hydrated chromium oxide layer within the range from 0.1 to 0.3 mg/dm².

Bath temperature: room temp. — 70° C;

Anodic current density: 0.5 – 8 A/dm², preferably 0.5 – 4 A/dm²;

Treating time: 0.5 – 2 sec;

Amount of electricity: 1 – 8 Coulomb/dm².

2 Claims, 1 Drawing Figure

PROCESS FOR MANUFACTURING ELECTROLYTICALLY CHROMATED STEEL SHEET

FIELD OF THE INVENTION

The present invention relates to a process for adjusting the thickness of the hydrated chromium oxide layer on the surface of an electrolytically chromated steel sheet within a desired range.

BACKGROUND OF THE INVENTION

An electrolytically chromated steel sheet is generally required to be excellent in such properties as surface color tone, paintability, printability and corrosion resistance. The surface film on an electrolytically chromated steel sheet comprises two layers: a metallic chromium layer and a hydrated chromium oxide layer formed on said metallic chromium layer. Of these layers, said upper hydrated chromium oxide layer exerts a very important effect on said properties of an electrolytically chromated steel sheet.

More specifically, an amount of the hydrated chromium oxide layer on the surface of an electrolytically chromated steel sheet (an amount expressed by the chromium content in the hydrated chromium oxide layer) exceeding 0.3mg/dm$^2$ seriously degrades the surface color tone of the electrolytically chromated steel sheet, and causes production of a surface stain. If the amount of a hydrated chromium oxide layer exceeds 0.4 mg/dm$^2$, paintability and printability worsen considerably. When the amount of a hydrated chromium oxide layer is under about 0.1mg/dm$^2$, on the other hand, satisfactory corrosion resistance cannot be obtained.

There are available the following two conventional processes for manufacturing an electrolytically chromated steel sheet:

a. A process, known as the dual-electrolyte process, comprising subjecting a steel sheet to a cathodic electrolytic treatment in an electrolyte containing hexavalent chromium at a relatively high concentration, to form a metallic chromium layer only on the surface of said steel sheet, and then, subjecting said steel sheet with said metallic chromium layer formed thereon to a chemical treatment or a cathodic electrolytic treatment in another electrolyte containing hexavalent chromium at a relatively low concentration, to form a hydrated chromium oxide layer on said metallic chromium layer; and b. A process, known as the single electrolyte process, comprising subjecting a steel sheet to a cathodic electrolytic treatment in an electrolyte containing hexavalent chromium at a relatively low concentration, to form simultaneously a lower metallic chromium layer and an upper hydrated chromium oxide layer on the surface of said steel sheet.

In said process (b) mentioned above, the amount of the hydrated chromium oxide layer exceeds 0.4mg/dm$^2$, varying with the conditions of cathodic electrolytic treatment, which results in a serious degradation of said properties of an electrolytically chromated steel sheet. It is therefore necessary to adjust the amount of deposited hydrated chromium oxides within a desired range.

The following processes have conventionally been proposed with a view to adjusting the amount of deposited hydrated chromium oxides in an electrolytic chromate treatment of a steel sheet:

1. Process which comprises raising the temperature of an electrolytic chromating bath;
2. Process which comprises adjusting the chemical composition of an electrolytic chromating bath;
3. Process which comprises scraping off part of the hydrated chromium oxide layer on the surface of an electrolytically chromated steel sheet with rolls (refer to the Japanese Patent Publication No. 16,334/74); and
4. Process which comprises dipping an electrolytically chromated steel sheet in an electrolytic chromating bath or a chromic acid solution, to dissolve part of the hydrated chromium oxide layer on the surface of said steel sheet.

In said process (1) mentioned above, the hydrated chromium oxide layer of an electrolytically chromated steel sheet becomes thin, which gives a better surface color tone and a higher paintability and printability but lowers the electrolytic deposition efficiency of metallic chromium. In order to obtain a metallic chromium layer of a desired thickness, therefore, it is necessary to provide a longer electrolytic chromating time, and hence, the productivity of electrolytically chromated steel sheets is reduced.

In said process (2) mentioned above compounds containing sulfuric acid radicals, silicofluoride and borofluoride are added in relatively large quantities into an electrolytic chromating bath. These additives affect the hardness and the cracking frequency of the metallic chromium layer on an electrolytically chromated steel sheet and the cracking frequency of the hydrated chromium oxide layer formed thereon. Furthermore, fluorine and sulfur, being adsorbed into the hydrated chromium oxide layer, degrade the corrosion resistance of the electrolytically chromated steel sheet. Moreover, the concentration control of these additives is very complicated and is hardly practicable. In an electrolytic chromating bath with the above-mentioned additives of which the concentration has been adjusted to achieve a thinner hydrated chromium oxide layer, the electrolytic deposition efficiency of the metallic chromium layer is not always high, thus leading to a decreased productivity of electrolytically chromated steel sheets.

In process (3) mentioned above, scratches tend to be easily produced on the surface of an electrolytically chromated steel sheet. In process (4) mentioned above, which is rather practical, the slow dissolution of the hydrated chromium oxide layer by dipping results in the necessity of a longer treatment time, and hence of a longer production line.

In view of these facts, there has been wanted a process for manufacturing an electrolytically chromated steel sheet, which comprises simultaneously forming a lower layer of metallic chromium and an upper layer of hydrated chromium oxides on the surface of a steel sheet in a single electrolytic chromating bath, and which permits adjustment of the thickness of said hydrated chromium oxide layer and gives a high productivity, but no such process has yet been proposed.

SUMMARY OF THE INVENTION

An object of the present invention is therefore to provide a process for manufacturing an electrolytically chromated steel sheet excellent in surface color tone, paintability, printability and corrosion resistance.

Another object of the present invention is to provide a process for manufacturing an electrolytically chromated steel sheet at a high productivity.

A principal object of the present invention is to provide, in simultaneously forming a lower layer of metallic chromium and an upper layer of hydrated chromium oxides at a high rate on the surface of a steel sheet by subjecting said steel sheet to a cathodic electrolytic chromate treatment in a single electrolytic chromating bath, a process for adjusting the thickness of said hydrated chromium oxide layer within a desired range.

In accordance with one of the features of the present invention, there is provided a process for manufacturing an electrolytically chromated steel sheet, which comprises:

subjecting a steel sheet to a cathodic electrolytic chromate treatment at a relatively high speed of 400 to 1,000m per minute in a conventional electrolytic chromating bath, to form simultaneously a lower layer of metallic chromium and an upper layer of hydrated chromium oxides on the surface of said steel sheet; and then, subjecting said electrolytically chromated steel sheet to an anodic electrolytic treatment under the following conditions in said electrolytic chromating bath, to adjust the amount of said hydrated chromium oxide layer within the range from 0.1 to 0.3mg/dm$^2$:

Bath temperature : room temp. — 70° C;

Anodic current density : 0.5 – 8A/dm$^2$, preferably 0.5 – 4A/dm$^2$;

Treating time : 0.5 – 2 sec;

Amount of electricity : 1 – 8 Coulomb/dm$^2$.

BRIEF DESCRIPTION OF THE DRAWING

The present invention is illustrated by way of example in the accompanying drawing, which forms part of this application and in which:

The FIGURE shows the relation between the amount of chromium in the hydrated chromium oxide layer and the anodic electrolytic treating time in an anodic electrolytic treatment applied to an electrolytically chromated steel sheet.

DETAILED DESCRIPTION OF PREFERRED EMBODIMENTS

Figure 1:
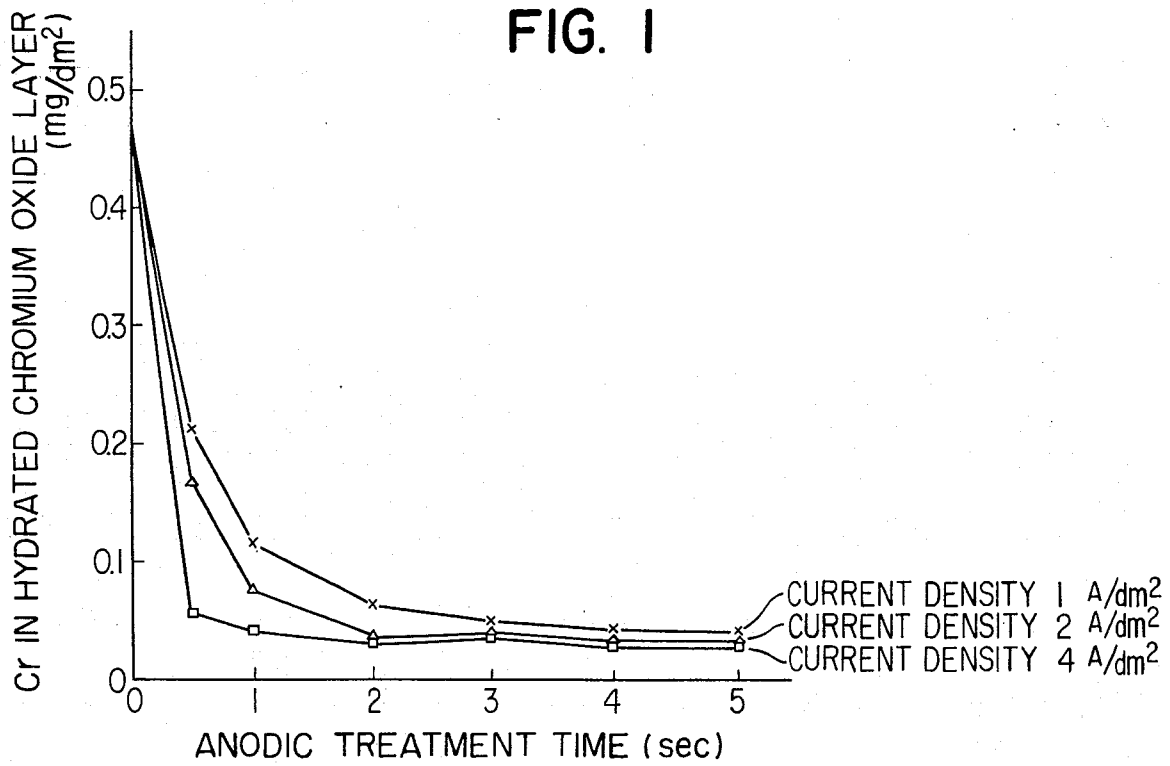

In view of the foregoing, the inventors conducted an intensive study on the process for producing at a high speed an electrolytically chromated steel sheet excellent in such properties as surface color tone, paintability, printability and corrosion resistance, and found as a result the possibility of obtaining at a high speed an electrolytically chromated steel sheet excellent in such properties as mentioned above by:

subjecting a steel sheet to a cathodic electrolytic chromate treatment at a relatively high speed of 400 to 1,000m per minute in a conventional electrolytic chromating bath, to form simultaneously a lower layer of metallic chromium and an upper layer of chromium oxides on the surface of said steel sheet; and then, subjecting said electrolytically chromated steel sheet to an anodic electrolytic treatment under the following conditions in said electrolytic chromating bath, to adjust the amount of said hydrated chromium oxide layer within the range from 0.1 to 0.3mg/dm$^2$:

Bath temperature : room temp. — 70° C;

Anodic current density : 0.5 – 8A/dm$^2$, preferably 0.5 – 4A/dm$^2$;

Treating time : 0.5 – 2 sec;

Amount of electricity : 1 – 8 Coulomb/dm$^2$.

In the conventional process for manufacturing an electrolytically chromated steel sheet, known as the singleelectrolyte process, which comprises simultaneous forming a lower metallic chromium layer and an upper hydrated chromium oxide layer on the surface of a steel sheet by subjecting said steel sheet to a cathodic electrolytic chromate treatment in a single electrolytic chromating bath, the electrolytic chromate treatment is usually applied to the steel sheet at a relatively low speed of 200 to 300m per minute. In an electrolytic chromate treatment at such a low speed, part of the hydrated chromium oxide layer deposited on the lower metallic chromium layer is dissolved again into the electrolytic chromating bath, and this results in a relatively small amount of the hydrated chromium oxide layer on the steel sheet surface after the electrolytic chromate treatment, it nonetheless amounts to over 0.4 mg/dm$^2$ as mentioned above. The electrolytic chromating speed of the steel sheet, if accelerated with a view to raising the productivity, leads to a further increased amount of deposited hydrated chromium oxide layer.

In the present invention, a steel sheet is subjected to a cathodic electrolytic chromate treatment at a relatively high speed of 400 to 1,000m per minute in an electrolytic chromating bath, for the purpose of raising the productivity of electrolytically chromated steel sheets. This naturally results in a larger amount of the hydrated chromium oxide layer. This larger amount is therefore adjusted within a desired range by applying an anodic electrolytic treatment as described later.

The chemical composition of an electrolytic chromating bath used for the cathodic electrolytic chromate treatment of a steel sheet in accordance with the present invention may be the same as that of a conventional electrolytic chromating bath. For example, any of the following electrolytes known as usual bath compositions may be conveniently employed:

1. An electrolyte containing chromic acid and a compound having a sulfuric acid radical;
2. An electrolyte containing chromic acid, a compound having a sulfuric acid radical, and a fluorine compound;
3. An electrolyte containing chromic acid and at least one compound selected from the group consisting of phenol-sulfonic acid, sodium thiocyanate, cryolite and borofluoric acid; and
4. An electrolyte containing a compound having hexavalent chromium in an amount of 5 to 200g/l expressed as chromic acid; and at least one compound selected from the group consisting of fluoride, silicofluoride, borofluoride, hydrogenfluoride and cryolite in an amount not exceeding 10g/l.

In the present invention, the steel sheet subjected to a cathodic electrolytic chromate treatment as mentioned above is then subjected to an anodic electrolytic treatment under the following conditions in the same treating bath:

Bath temperature : room temp. — 70° C;

Anodic current density : 0.5 – 8A/dm$^2$, preferably 0.5 – 4A/dm$^2$;

Treating time : 0.5 – 2 sec;

Amount of electricity : 1 –8 Coulomb/dm$^2$.

The reasons why the anodic electrolytic treatment conditions of the electrolytically chromated steel sheet are limited as shown above in the present invention are described below.

The hydrated chromium oxide layer deposited on the metallic chromium layer on an electrolytically chromated steel sheet comprises a film in gel form mainly containing $Cr^{3+}$, and this $Cr^{3+}$ is oxidized into $Cr^{6+}$ by an anodic electrolytic treatment in an electrolytic chromating bath through the reaction:

$$Cr^{3+} \rightarrow Cr^{6+} + 3e.$$

In other words, the hydrated chromium oxides present are dissolved again into the electrolytic chromating bath.

As described previously, the amount of the hydrated chromium oxide layer deposited on the metallic chromium layer on an electrolytically chromated steel sheet, when exceeding 0.3mg/dm², seriously degrades the surface color tone of the electrolytically chromated steel sheet, and may cause surface stains; and when exceeding 0.4mg/dm², very much impairs paintability and printability. On the other hand, an amount of the hydrated chromium oxide layer of under 0.1mg/dm² cannot give satisfactory corrosion resistance. It is therefore necessary to adjust the amount of the hydrated chromium oxide layer on an electrolytically chromated steel sheet within the range from 0.1 to 0.3mg/dm².

In the anodic electrolytic treatment in the present invention, an amount of electricity of over 8 Coulomb/dm² causes dissolution of most of the hydrated chromium oxide layer back into the electrolytic chromating bath and thus prevents an amount of over 0.1mg/dm² from being ensured. Furthermore, the reaction:

$$Cr^{0} \rightarrow Cr^{6+} + 6e$$

taking place in the metallic chromium layer also causes re-dissolution of the metallic chromium layer into the electrolytic chromating bath. With an amount of electricity of under 1 coulomb/dm², on the other hand, the dissolution of the hydrated chromium oxide layer is almost nonexistent. It is therefore necessary to use an amount of electricity within the range from 1 to 8 Coulomb/dm². In order to apply an anodic electrolytic treatment to an electrolytically chromated steel sheet at a high speed corresponding to a cathodic electrolytic chromating speed of a steel sheet of 400 to 1,000m/min and with an amount of electricity within the above-mentioned range, the anodic current density should be 0.5 to 8A/dm², preferably 0.5 to 4A/dm², and the treating time should be within the range from 0.5 to 2 sec. It is not necessary to cool the electrolytic chromating bath, which may be at the room temperature. A bath temperature exceeding 70° C is not desirable, because it lowers the electrolytic deposition efficiency of the metallic chromium layer and the hydrated chromium oxide layer in the preceding cathodic electrolytic chromate treatment applied in the same treating bath.

Now, the present invention is described further in detail with reference to an example.

EXAMPLE

A steel sheet was subjected to a cathodic electrolytic chromate treatment under the following conditions:

Chromic acid ($CrO_3$) : 100g/l,
Sodium thiocyanate (NaSCN) : 0.3g/l,
Borofluoric acid ($HBF_4$) : 0.9g/l,
(2) Bath temperature : 45° C
(3) Cathodic current density : 20A/dm²,
(4) Treating time : 3 sec.

A lower metallic chromium layer and an upper hydrated chromium oxide layer were thus formed on the surface of the steel sheet. The optimum temperature of an electrolytic chromating bath depends upon the chemical composition of the bath. By holding this temperature at a relatively low level, the electrolytic deposition efficiency of metallic chromium and hydrated chromium oxide is raised, and it is thus possible to speed up the production line.

Then, the electrolytically chromated steel sheet obtained as mentioned above was subjected to an anodic electrolytic treatment in the same bath used in said cathodic electrolytic chromate treatment, with an anodic current density of 1, 2 and 4A/dm², respectively, and for an anodic electrolytic treating time of 0.5, 1, 2, 3, 4 and 5 seconds, respectively. The chromium content of the hydrated chromium oxide layer on the electrolytically chromated steel sheet after said anodic electrolytic treatment was measured. The results of this measurement are shown in FIG. 1.

As shown in FIG. 1, a higher anodic current density permits rapid decrease decrease in the amount of the hydrated chromium oxide layer. Within the range of current density from 0.5 to 4A/dm², in particular, it is possible to adjust the amount of the hydrated chromium oxide layer within the desired range from 0.1 to 0.3mg/dm² in a very short anodic electrolytic treating time of 0.5 to 2 seconds. This reveals that, according to the present invention, it is possible to easily accelerate the treatment on a production line of electrolytically chromated steel sheets, together with speeding-up of the preceding cathodic electrolytic chromate treatment of steel sheets.

According to the present invention, as described above in detail, it is possible to produce at a high speed an electrolytically chromated steel sheet excellent in paintability, printability and corrosion resistance, with a beautiful appearance and without the occurrence of stains on the surface, and thus industrially useful effects are provided.

What is claimed is:

1. In a process for manufacturing an electrolytically chromated steel sheet, which comprises subjecting a steel sheet to a cathodic electrolytic chromate treatment in an electrolytic chromating bath to form simultaneously a lower layer of metallic chromium and an upper layer of hydrated chromium oxides on the surface of said steel sheet, and adjusting the amount of said hydrated chromium oxide layer within a desired range, the improvement characterized by:

subjecting a steel sheet to a cathodic electrolytic chromate treatment at a relatively high speed of 400 to 1,000m per minute in a conventional electrolytic chromating bath, to form simultaneously a lower layer of metallic chromium and an upper layer of hydrated chromium oxides on the surface of said steel sheet; and then, subjecting said electrolytically chromated steel sheet to an anodic electrolytic treatment under the following conditions in said electrolytic chromating bath, to adjust the amount of said hydrated chromium oxide layer within the range from 0.1 to 0.3mg/dm²:

Bath temperature : room temp. — 70° C,
Anodic current density : 0.5 – 8A/dm²,
Treating time : 0.5 – 2 sec,
Amount of electricity : 1 – 8 Coulomb/dm².

2. The process of claim 1, wherein said anodic current density in said anodic electrolytic treatment is within the range from 0.5 – 4A/dm².

* * * * *

UNITED STATES PATENT OFFICE

CERTIFICATE OF CORRECTION

PATENT NO. : 3,986,940

DATED : October 19, 1976

INVENTOR(S) : HIROSHI TAKANO et al

It is certified that error appears in the above-identified patent and that said Letters Patent are hereby corrected as shown below:

Column 5, between lines 62 and 63, insert the following:

--- (1) Chemical composition of the electrolytic chromating bath: ---.

In the drawing at the second page of the printed patent: delete the legend "FIG. 1".

Signed and Sealed this

*ninth* Day of *August 1977*

[SEAL]

*Attest:*

RUTH C. MASON
*Attesting Officer*

C. MARSHALL DANN
*Commissioner of Patents and Trademarks*